US012516580B2

(12) United States Patent
Harper et al.

(10) Patent No.: US 12,516,580 B2
(45) Date of Patent: Jan. 6, 2026

(54) ACTIVATOR, TOOLS, AND METHOD

(71) Applicant: Baker Hughes Oilfield Operations LLC, Houston, TX (US)

(72) Inventors: Jason Harper, Cypress, TX (US); Zhihui Zhang, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/749,845

(22) Filed: Jun. 21, 2024

(65) Prior Publication Data

US 2025/0389163 A1 Dec. 25, 2025

(51) Int. Cl.
*E21B 23/04* (2006.01)

(52) U.S. Cl.
CPC ..... *E21B 23/0413* (2020.05)

(58) Field of Classification Search
CPC ..... E21B 23/0413
See application file for complete search history.

(56) References Cited

U.S. PATENT DOCUMENTS 3,849,097 A * 11/1974 Giffen ..... C03C 17/02 65/121
11,346,171 B2 * 5/2022 Yuan ..... E21B 23/0413
2016/0137548 A1 5/2016 Cabral, Jr.
2017/0022783 A1 1/2017 Yong
2017/0159419 A1 6/2017 Tolman
2022/0251922 A1 * 8/2022 Hiorth ..... E21B 34/103
2022/0349276 A1 * 11/2022 Kumar ..... E21B 33/12
2025/0012156 A1 * 1/2025 Ewing ..... E21B 23/01

FOREIGN PATENT DOCUMENTS

BR 112018013557 B1 * 11/2022 ..... E21B 34/063

OTHER PUBLICATIONS

Cashman et al.; "Prince Rupert's Drops: an analysis of fragmentation by thermal stresses and quench granulation of glass and bubbly glass", PNAS 2022 vol. 119 No. 31 e2202856119 https://doi.org/10.1073/pnas. 2202856119, 10 pages. (Year: 2022).*

(Continued)

*Primary Examiner* — James G Sayre
(74) *Attorney, Agent, or Firm* — CANTOR COLBURN LLP

(57) ABSTRACT

An activator including a body surface layer with a stress of at least 200 Mega Pascals (MPa), and a trigger extending from the body to release the stress in the body. A downhole tool, including a first component, a second component that is movable relative to the first component, and an activator disposed to prevent movement between the first and second components, the activator having a surface layer with a stress of at least 200 Mega Pascals (MPa). A barrier tool, including a tubular housing, a mass of material having a surface with a stress of at least 200 MPa within the housing to prevent fluid flowing through the housing, a trigger extending from the mass, and a trigger breaker movable relative to the trigger. A method including applying an input to an activator, disturbing the trigger with the input, and comminuting the body by releasing the stress therein.

21 Claims, 8 Drawing Sheets

(56) References Cited

OTHER PUBLICATIONS

Fantom™ Completion Accessories; https://www.entechteam.com/pt_BR/fantom; retrieved from the internet on Feb/ 22, 2014: 9 pages (Year: 2014).*

Cashman, et al.; "Prince Rupert's Drops: an analysis of fragmentation by thermalstresses and quench granulation of glass and bubbly glass"; PNAS 2022 vol. 119 No. 31 e2202856119 https://doi.org/10.1073/pnas.2202856119; 10 pages.

Fantom™ Completion Accessories; https://www.entechteam.com/pt_BR/fantom; retrieved from the internet on Feb. 22, 2014: 9 pages.

H. Aben; J. Anton; M. Õis; K. Viswanathan ; S. Chandrasekar; M. M. Chaudhri; "On the extraordinary strength of Prince Rupert's drops"; Appl. Phys. Lett. 109, 231903 (2016); https://doi.org/10.1063/1.4971339; 5 pages.

Notification of Transmittal of the International Search Report and the Written Opinion of the International Searching Authority, or the Declaration; PCT/US2025/021955; Mail date: Jul. 16, 2025; 12 pages.

* cited by examiner

ACTIVATOR, TOOLS, AND METHOD

BACKGROUND

In the resource recovery industry and fluid sequestration industry timing of operations is important to overall productivity. While many types of activation devices and arrangements have been known to the art, each has both benefits and detriments and hence there is still an ongoing desire to add new activator types that have different benefits so as to be helpful in scenarios in which current methods fail to deliver stellar results.

SUMMARY

An embodiment of an activator including a body having a body surface layer with a stress of at least 200 Mega Pascals (MPa), and a trigger extending from the body and configured to release the stress in the body.

An embodiment of a downhole tool, including a first component, a second component that is movable relative to the first component, and an activator disposed to prevent relative movement between the first and second components, the activator having a surface layer with a stress of at least 200 Mega Pascals (MPa).

An embodiment of a barrier tool, including a tubular housing, a mass of material having a surface with a stress of at least 200 MPa disposed within the housing and configured to prevent fluid flowing through the housing, a trigger extending from the mass of material, and a selectively actuable trigger breaker movable relative to the trigger.

An embodiment of a method for actuating a tool, including applying an input to the activator, disturbing the trigger with the input, and comminuting the body by releasing the stress therein.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
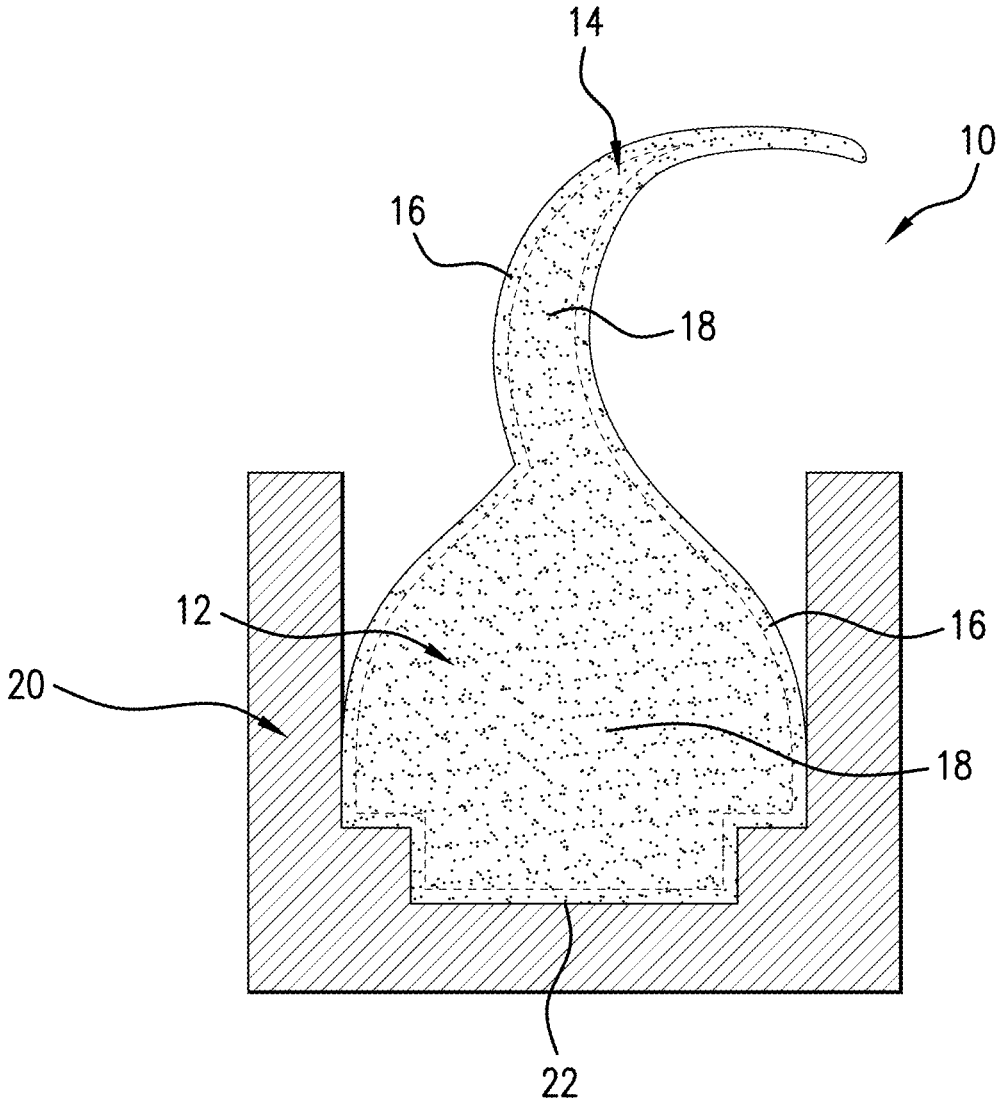
FIG. 1 schematically illustrates an activator as disclosed herein in a mold.

Referring to FIG. 1, an activator 10 is illustrated. The activator 10 includes a body 12 and a trigger 14 in the form of a tail. Activator 10 in this image is incidentally illustrated in a mold, which is one way in which the activator 10 may be formed. This will be discussed later herein. Activator 10, in an embodiment is formed of glass having a surface layer 16 that is in compressive stress and an inner layer 18 inwardly disposed of the surface layer 16 that is in tensile stress. The inner layer 18 tends to pull the surface layer 16 inwardly while the surface layer 16 tends to close any cracks rather than allowing them to open. In the body 12, the compressively stressed layer in combination with high stiffness (i.e. greater than 2 million pound-force per inch, lbf/in) results in an enormous stability when exposed to impact or compression. In the trigger 14, however, no such resistance is exhibited due to the much-reduced stiffness (i.e. less than 0.3 million lbf/in calculated for a cross-sectional area of the trigger) in combination with a length of the trigger causing the trigger to break at only a few tens of pounds of applied force. In fact, disturbing the trigger 14 not only will break the trigger 14 easily but that breakage will also cause the body to explosively comminute. The properties just described are those of a Prince Rupert's drop (PRD). As is known by many, the Prince Rupert's drop is a curiosity due to the ability of the body to withstand significant load while the tail remains fragile. Yet, perturbation of that tail will cause the instantaneous demise of the body. The properties of the PRD have been harnessed by the inventors hereof to activate tools.

For purposes hereof, a compression stress in layer 16 for the activator 10 is greater than about 200 Mega Pascals (MPa). The surface layer 16 represents about 5 percent to about 35 percent of a thickness of the inner layer 18 giving a compressive-to-tensile stress ratio of approximately above 1.5:1. In other words, the stress in the inner layer 18 is less than about two thirds the stress that is in the surface layer 16. Activator 10 in an embodiment is composed of glass or containing an amorphous phase (e.g., ceramic glass) that exhibits a compressive strength above 1000 MPa (150 ksi "thousand pounds per square inch") to accommodate the generated stress in the surface layer and in an embodiment is the glass can be selected from soda-lime silicate glass or alkali aluminosilicate glass. In another embodiment, the material may be a ceramic glass manufactured from a mixture of glass and ceramic materials. To produce the particular surface stress indicated using a thermal method includes bringing the material of activator 10 to a glass transition temperature and then quenching the material in a fluid such as oil, water, air, etc., The quench temperature is above 500 degrees Celsius, or between the glass transition temperature and softening point of the material of the activator 10. Temperature of glass based upon viscosity are as follows: Working point 10^4 Poise, pressing, blowing; Flow point 10^5 Poise, glass begins to flow freely if unrestrained; Softening point 10^7.6 Poise, glass deforms visibly under its own weight; Glass transition 10^12 Poise; Annealing point 10^13 Poise, stress relieved in several minutes; Strain point 10^14.5 Poise, stress relieved in several hours. Alternatively, molten glass may be first disposed in a mold to attain a designed shape, followed by reheating of the part and mold and quenching to create the stress gradient.

In some embodiments, which will depend upon the geometric shape of the mold, the activator 10 may suffer from incomplete generation of compressive stress. This may occur in areas of a change in direction of a plane such as for example a 90 degree bend. In these embodiments, it is desirable to modify the mold to include areas of the mold undergoing higher heat flux, or flow of heat energy per unit area per unit time with higher thermal conductivity to allow the sections of the mold with direction changes to effectively extract heat from the glass and quench the glass uniformly to generate compressional stress. Higher quenching capacity by the mold may be achieved with additional thermal elements placed therein or adjacent thereto, while higher thermal conductivity may be achieved by a change in the material used for the mold to a material inherently higher in thermal conductivity in certain areas in need of such higher thermal conductivity, for example, an aluminum might be substituted for an iron as the former has a much higher thermal conductivity than the latter.

In another embodiment the mold can be first filled with glass powder, or a mixture of glass and ceramic powder, and then heated to above the working point of glass to form a desired shape. The shaped glass is then quenched to create the stress gradient. Alternatively, the compression stress is achievable using an ion exchange method where smaller ions are stripped from the surface of activator 10 and replaced with larger ions. For example, where the material is a sodium aluminosilicate glass, a surface of the glass may be exposed to a molten bath of potassium nitrate. During this exposure, a smaller sodium ion at the surface of the glass is substituted by a larger potassium ion through a diffusion process because of the ion concentration gradient between the glass and the molten bath. The ion exchange temperature is selected between about 400 C to about 550 C or below the strain point (the maximum temperature at which a glass can be used for structural applications without undergoing creep) of the glass material. Alternatively in the ion exchange space, instead of placing the component in a potassium molten bath, the component may also be covered by a slurry that contains potassium nitrate, refractory oxides, and a fluid carrier. The refractory oxides include aluminum oxide, magnesium oxide, titanium oxide, zirconium oxide. The fluid carrier includes water and volatile organic compounds. After the slurry is applied, the fluid is evaporated leaving the oxides to hold the potassium nitrate in place at the exchange temperatures. The selection of potassium nitrate is common for ion exchange as it has a melting point of about 334 Celsius such that the molten bath temperature is high enough to activate the diffusion process for the ion exchange while remaining below the softening point of glass. The substitution of a larger ion K+ for a small ion Na+ in a molten salt is known to those of skill in the art and hence need not be described in detail.

Referring to FIG. 1, the PRD is formed in a mold 20 so that a base 22 of the activator 10 may be seated in a structure for which it is molded. In this condition the activator 10 may hold pressure against a seat 24 such as that schematically illustrated in FIG. 2. Functions contemplated for the base 22 include grooves for O-rings or other seals, specific diameter configurations for seating and nesting, etc. As will be appreciated, because the activator 10 behaves in the same was that a PRD behaves, the body 12 will exhibit great strength properties and hence hold large pressure differentials or resist movement of solid objects until the trigger 14 is disturbed.

Figure 2:
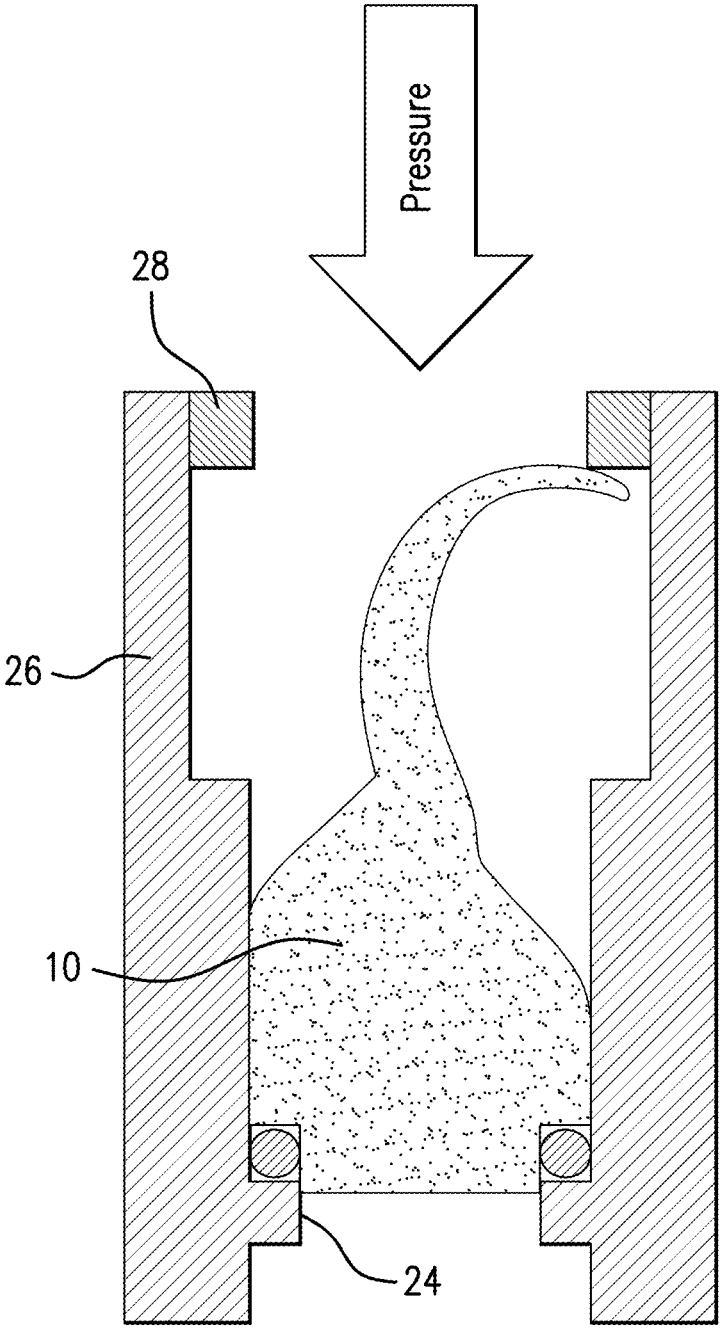
FIG. 2 schematically illustrates a tool in a first position.
Figure 3:
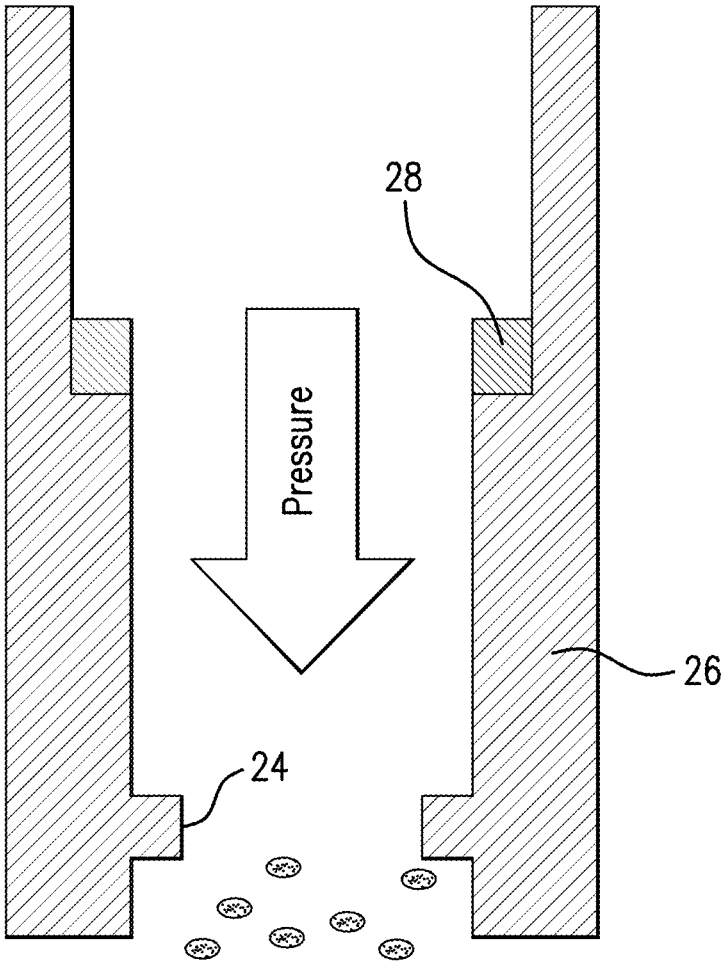
FIG. 3 schematically illustrates the tool of FIG. 2 in a second position.

Referring to FIGS. 2 and 3, one tool configuration is illustrated where the activator 10 holds pressure against seat 24 inside of a housing 26 until a sleeve 28 disposed in the housing 26 is shifted from a first position shown in FIG. 2 to a second position shown in FIG. 3. The sleeve 28 may be itself moved by hydraulic pressure against a piston (not specifically shown) that is responsive to applied pressure in the string or annulus or in a hydraulic line from a remote location such as a surface location, a signal (electric, magnetic, acoustic, etc.) conveyed to the sleeve 28 or to an actuator (not specifically shown) that moves the sleeve (a prime mover being a motor, solenoid, etc.), a mechanical intervention using for example slickline, wireline, etc. that can mechanically push on the sleeve 28 or engage therewith through a profile, etc., dropped devices such as balls, darts, other objects released from uphole of the activator 10, including from the surface. Further contemplated are sensors looking for a particular parameter (temperature, pressure, time, etc.) before conveying a signal to the sleeve 28 actuator, etc. It should be understood that many actuator configurations may be used to cause the sleeve 28 to move and disturb the trigger 14 but the activator 10 is capable of holding substantially more pressure or load than any of such devices of the past could hold and yet is easily removable by using these actuators of the past to disturb the trigger 14. The movement of sleeve 28 from the position in FIG. 2 to the position in FIG. 3 will cause sleeve 28 to contact the trigger 14, easily disrupting the same, and causing the characteristic explosive comminution of the body 12 of the activator 10 along with the trigger 14. The particle size of the comminuted activator 10 is less than about 0.25 inch and hence it is easy for those particles to disperse and not present an impediment to further operations.

Figure 4:
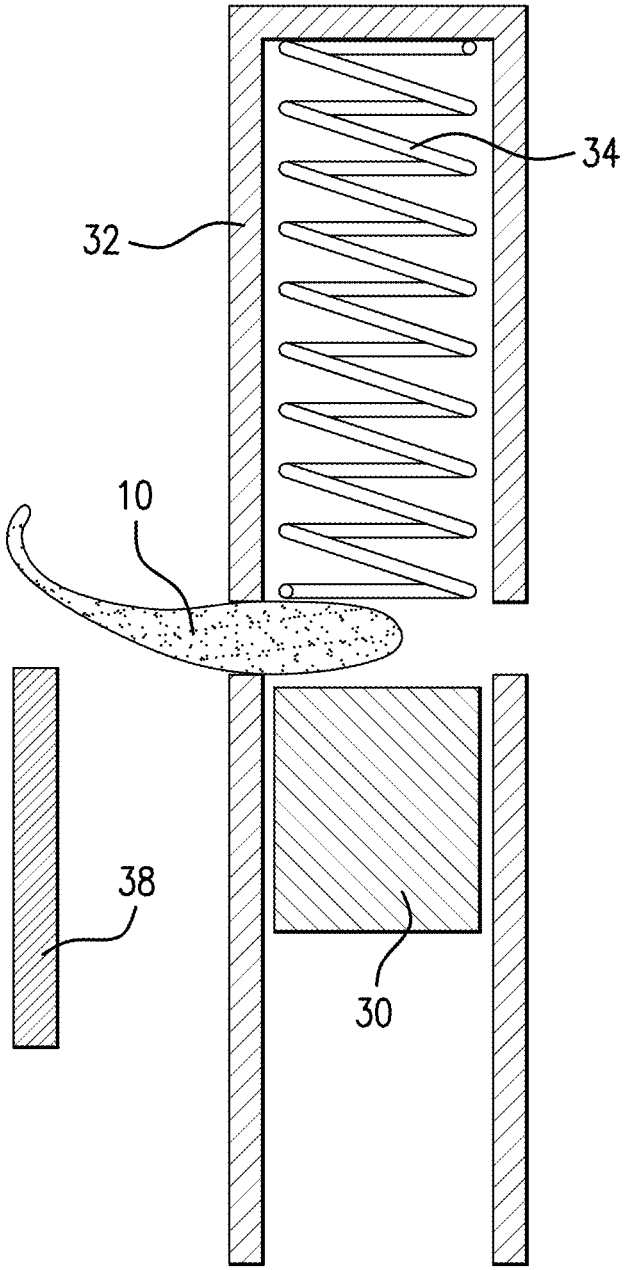
FIG. 4 schematically illustrates another tool in a first position.
Figure 5:
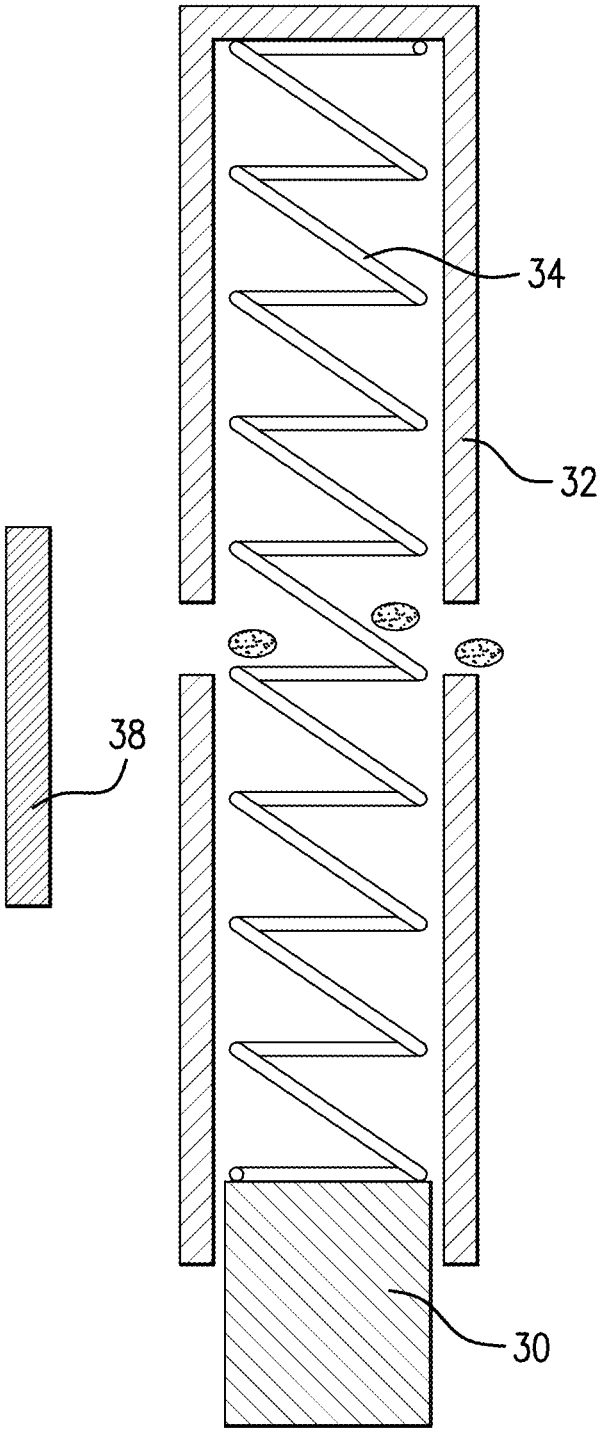
FIG. 5 schematically illustrates the tool of FIG. 4 in a second position.

Referring now to FIGS. 4 and 5, another embodiment is illustrated wherein the activator 10 is utilized to prevent a mechanical movement until the trigger 14 is disturbed. In this embodiment, a piston 30 is disposed in a housing 32 and locked in place with the activator 10, extending through the housing 32, against a biaser 34 in a state of stored potential energy. The trigger 14 is made available for contact with a sleeve 38 similar to sleeve 28 but disposed radially outwardly of the housing 32. Sleeve 38 is actuable by any of the same actuation apparatus and methods discussed with regard to sleeve 28 the same manner. Upon contact of sleeve 38 with trigger 14, the body 12 will experience explosive comminution and effectively disappear, leaving piston 30 free to move under the influence of the biaser 34.

Figure 6:
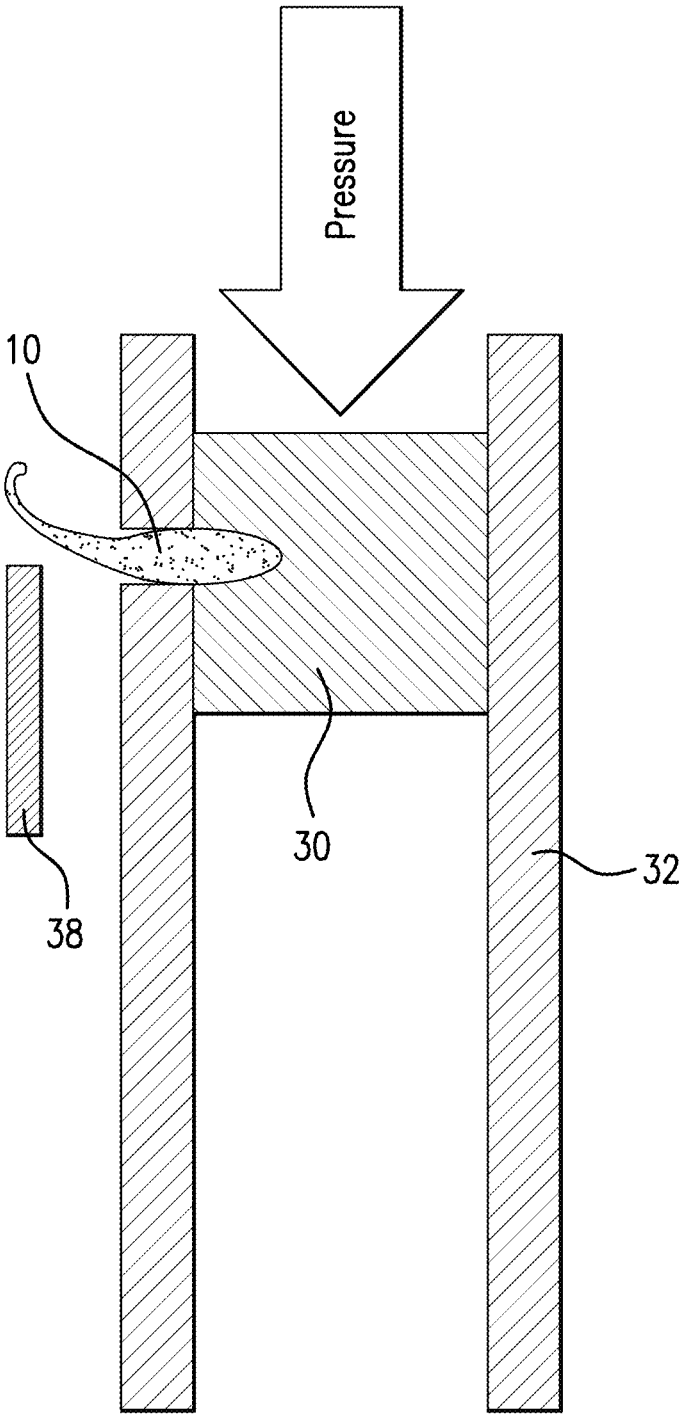
FIG. 6 schematically illustrates yet another tool in a first position.
Figure 7:
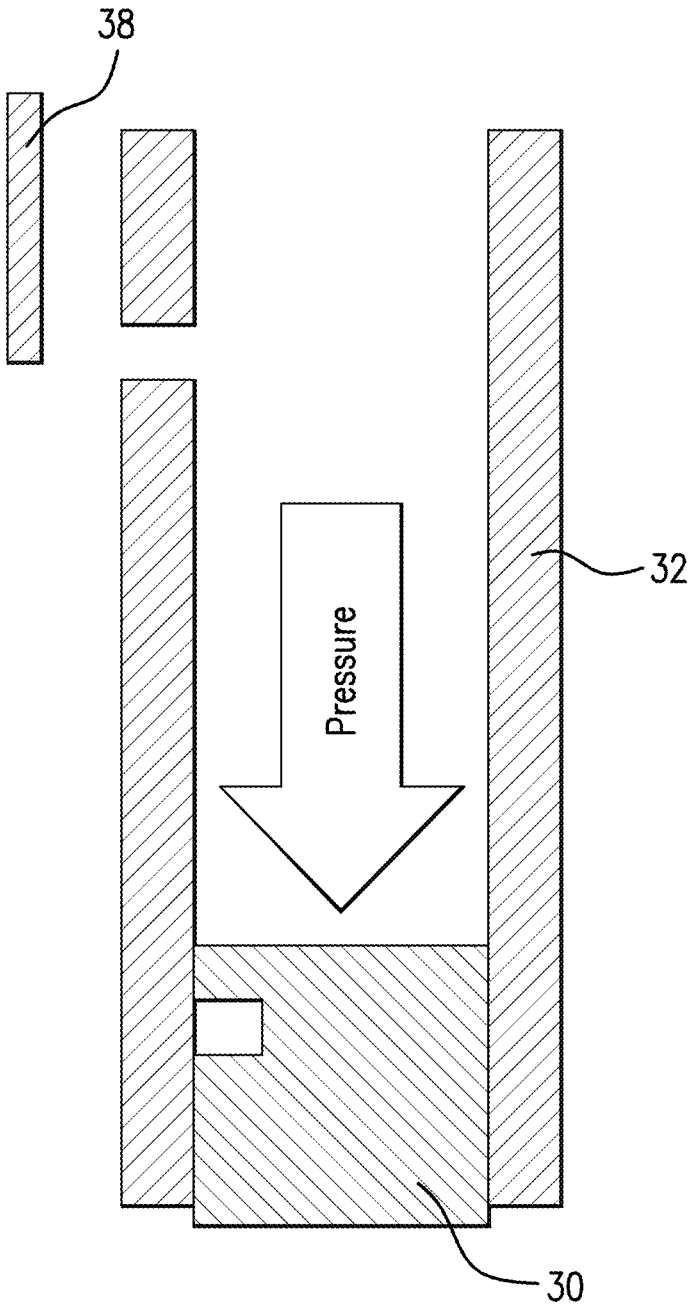
FIG. 7 schematically illustrates the tool of FIG. 6 in a second position.

In yet another embodiment, referring to FIGS. 6 and 7, a similar configuration to that of FIGS. 4 and 5 is illustrated but without a biaser. Rather in this embodiment, pressure is the motive force behind movement of the piston 30. The piston 30 cannot however move until the activator 10 is triggered and removed in the same ways that FIGS. 2-5 are done. It is to be appreciated that in the FIGS. 6 and 7 embodiments, the direction of movement of the sleeve 38 is opposite that of FIGS. 4 and 5. It will be appreciated that direction is irrelevant to the ultimate function as perturbation of the trigger 14 in any direction is sufficient to cause the comminution of the body 12. It is also noted that rotational actuators are also contemplated that may be driven by all of the same prime movers as described with respect to FIGS. 2 and 3. Due to the formidable strength of the body 12, great pressure may be contained by the piston 30 until the trigger 14 is disturbed, following which the piston may move unimpeded by the activator 10.

Figure 8:
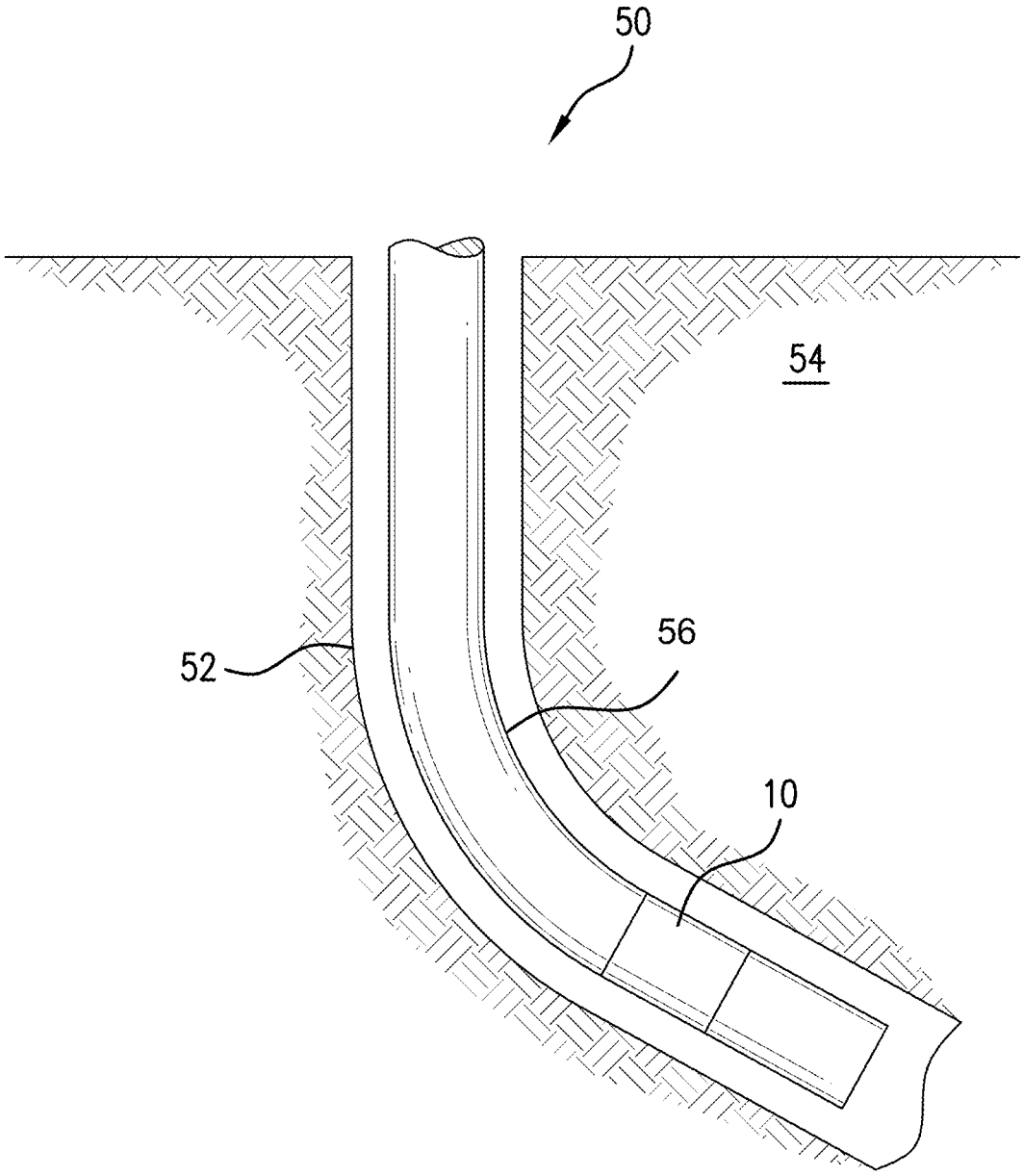
FIG. 8 is a view of a borehole system including the activator as disclosed herein.

Referring to FIG. 8, a borehole system 50 is schematically illustrated. The system 50 comprises a borehole 52 in a subsurface formation 54. A string 56 is disposed within the borehole 52. The activator 10 is disposed within or as a part of the string 56 disclosed herein with or apart from any of the tools illustrated in FIGS. 2-7.

Set forth below are some embodiments of the foregoing disclosure:

Embodiment 1: An activator including a body having a body surface layer with a stress of at least 200 Mega Pascals (MPa), and a trigger extending from the body and configured to release the stress in the body.

Embodiment 2: The activator as in any prior embodiment, wherein the body comprises glass.

Embodiment 3: The activator as in any prior embodiment, wherein the body includes a body layer inwardly disposed of the surface.

Embodiment 4: The activator as in any prior embodiment, wherein the body layer inwardly disposed has a stress of less than about two-thirds of the stress in the body surface layer.

Embodiment 5: The activator as in any prior embodiment, wherein the body surface layer has a thickness that is about 5 percent to about 35 percent of a thickness of the body layer inwardly disposed.

Embodiment 6: The activator as in any prior embodiment, wherein the trigger is cross sectionally dimensionally smaller than the body.

Embodiment 7: The activator as in any prior embodiment, wherein the trigger includes a trigger surface layer with a stress of at least 200 Mega Pascals (MPa).

Embodiment 8: The activator as in any prior embodiment, wherein the trigger includes a trigger layer inwardly disposed of the surface layer.

Embodiment 9: The activator as in any prior embodiment, wherein the trigger layer inwardly disposed has a stress of less than about two-thirds of the stress in the trigger surface layer.

Embodiment 10: The activator as in any prior embodiment, wherein when the stress in the body is released, a material of the body comminutes to a particle size of less than about 0.25 inch Embodiment 11: The activator as in any prior embodiment, is a Prince Rupert's drop.

Embodiment 12: The activator as in any prior embodiment, wherein the body is a formed mass.

Embodiment 13: The activator as in any prior embodiment, wherein the formed mass is ion exchanged to produce the body surface layer stress.

Embodiment 14: The activator as in any prior embodiment, wherein the formed mass includes a trigger surface layer having a trigger surface layer stress created by ion exchange.

Embodiment 15: The activator as in any prior embodiment, wherein the formed mass is additively manufactured.

Embodiment 16: The activator as in any prior embodiment, wherein the formed mass is cast.

Embodiment 17: A downhole tool, including a first component, a second component that is movable relative to the first component, and an activator disposed to prevent relative movement between the first and second components, the activator having a surface layer with a stress of at least 200 Mega Pascals (MPa).

Embodiment 18: A barrier tool, including a tubular housing, a mass of material having a surface with a stress of at least 200 MPa disposed within the housing and configured to prevent fluid flowing through the housing, a trigger extending from the mass of material, and a selectively actuable trigger breaker movable relative to the trigger.

Embodiment 19: A method for actuating a tool, including applying an input to the activator as in any prior embodiment, disturbing the trigger with the input, and comminuting the body by releasing the stress therein.

Embodiment 20: The method as in any prior embodiment, wherein the applying is shifting a component of the tool into contact with the trigger.

Embodiment 21: The method as in any prior embodiment, wherein the comminuting is to a particle size of less than about 0.25 inch.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "approximately", "substantially" and "generally" are intended to include the degree of error associated with measurement of the particular quantity based upon the equipment available at the time of filing the application. For example, "about" and/or "approximately", and/or "substantially" and/or "generally" can include a range of ±8% a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An activator, comprising:

a body having a body surface layer with a stress of at least 200 Mega Pascals (MPa) configured for disposal in a downhole tool and initially preventing activation of the tool; and a trigger that is integrally formed with the body and extends from the body, trigger having a cross-sectional area divided by length that is less than 15 percent of a cross-sectional area divided by length of the body, the trigger configured to release the stress in the body.

2. The activator as claimed in claim 1, wherein the body comprises glass.

3. The activator as claimed in claim 1, wherein the body includes a body layer inwardly disposed of the surface.

4. The activator as claimed in claim 3, wherein the body layer inwardly disposed has a stress of less than about two-thirds of the stress in the body surface layer.

5. The activator as claimed in claim 1, wherein the body surface layer has a thickness that is about 5 percent to about 35 percent of a thickness of the body layer inwardly disposed.

6. The activator as claimed in claim 1, wherein the trigger is cross sectionally dimensionally smaller than the body.

7. The activator as claimed in claim 1, wherein the trigger includes a trigger surface layer with a stress of at least 200 Mega Pascals (MPa).

8. The activator as claimed in claim 1, wherein the trigger includes a trigger layer inwardly disposed of the surface layer.

9. The activator as claimed in claim 8, wherein the trigger layer inwardly disposed has a stress of less than about two-thirds of the stress in the trigger surface layer.

10. The activator as claimed in claim 1, wherein when the stress in the body is released, a material of the body comminutes to a particle size of less than about 0.25 inch.

11. The activator as claimed in claim 1, is a Prince Rupert's drop.

12. The activator as claimed in claim 1, wherein the body is a formed mass.

13. The activator as claimed in claim 12, wherein the formed mass is ion exchanged to produce the body surface layer stress.

14. The activator as claimed in claim 13, wherein the formed mass includes a trigger surface layer having a trigger surface layer stress created by ion exchange.

15. The activator as claimed in claim 12, wherein the formed mass is additively manufactured.

16. The activator as claimed in claim 1, wherein the formed mass is cast.

17. A downhole tool, comprising:

a first component;

a second component that is movable relative to the first component; and an activator having a body disposed to prevent relative movement between the first and second components, the body having a surface layer with a stress of at least 200 Mega Pascals (MPa) and a trigger that is integrally formed with the body and extends from the body, trigger having a cross-sectional area divided by length that is less than 15 percent of a cross-sectional area divided by length of the body, the trigger configured to release the stress in the body.

18. A barrier tool, comprising:

a tubular housing;

a mass of material having a surface with a stress of at least 200 MPa disposed within the housing and configured to prevent fluid flowing through the housing;

a trigger that is integrally formed with the mass of material and extends from the mass of material, trigger having a cross-sectional area divided by length that is less than 15 percent of a cross-sectional area divided by length of the body, the trigger configured to release the stress in the mass of material; and a selectively actuable trigger breaker movable relative to the trigger.

19. A method for actuating a tool, comprising:

applying an input to the activator as claimed in claim 1;

disturbing the trigger with the input; and comminuting the body by releasing the stress therein.

20. The method as claimed in claim 19, wherein the applying is shifting a component of the tool into contact with the trigger.

21. The method as claimed in claim 19, wherein the comminuting is to a particle size of less than about 0.25 inch.

* * * * *